US010409225B2

(12) United States Patent
Suzuki et al.

(10) Patent No.: US 10,409,225 B2
(45) Date of Patent: Sep. 10, 2019

(54) DIAL AND TIMEPIECE

(71) Applicant: CASIO COMPUTER CO., LTD., Shibuya-ku, Tokyo (JP)

(72) Inventors: Junichiro Suzuki, Kunitachi (JP); Kazuma Kobayashi, Fuchu (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 151 days.

(21) Appl. No.: 15/374,461

(22) Filed: Dec. 9, 2016

(65) Prior Publication Data

US 2017/0248920 A1 Aug. 31, 2017

(30) Foreign Application Priority Data

Feb. 29, 2016 (JP) ..... 2016-037131

(51) Int. Cl.
*G04B 19/16* (2006.01)
*G04G 3/00* (2006.01)
*G04B 19/12* (2006.01)

(52) U.S. Cl.
CPC ..... *G04B 19/166* (2013.01); *G04B 19/12* (2013.01); *G04G 3/00* (2013.01)

(58) Field of Classification Search
CPC .... G04B 19/166; G04B 19/268; G04B 19/06; G04B 19/20
USPC ..... 368/223, 228
See application file for complete search history.

(56) References Cited

U.S. PATENT DOCUMENTS 1,670,074 A 5/1928 Mathez
2,834,250 A * 5/1958 Stefani ..... G04B 19/34 235/61 PK
4,041,325 A * 8/1977 Angott ..... H01H 43/127 200/35 R
4,684,260 A 8/1987 Jackle
5,222,053 A * 6/1993 Ohhira ..... G04C 19/00 368/228
6,466,522 B1 * 10/2002 Yoshioka ..... G04B 19/12 368/205
8,743,664 B2 6/2014 Mintiens
8,758,884 B2 * 6/2014 Hiroe ..... G01D 13/02 368/223
8,942,068 B2 * 1/2015 Fujisawa ..... G04G 5/002 368/47
2003/0193842 A1 * 10/2003 Harrison ..... G04B 25/00 368/82

(Continued)

FOREIGN PATENT DOCUMENTS

CN 102939569 A 2/2013
JP 49062456 U1 9/1972

(Continued)

OTHER PUBLICATIONS

Japanese Office Action (and English language translation thereof) dated May 8, 2018 issued in corresponding Japanese Application No. 2016-037131.

(Continued)

*Primary Examiner* — Edwin A. Leon
*Assistant Examiner* — Jason M Collins
(74) *Attorney, Agent, or Firm* — Holtz, Holtz & Volek PC

(57) ABSTRACT

A dial including: a rotating body which is provided to be rotatable; and a dial main body which includes a covering section that covers a peripheral portion of the rotating body.

9 Claims, 1 Drawing Sheet

(56) References Cited

U.S. PATENT DOCUMENTS

| | | | | |
|---|---|---|---|---|
| 2009/0274010 | A1* | 11/2009 | Vuilleumier ..... | G04B 19/26<br>368/18 |
| 2012/0287762 | A1 | 11/2012 | Mintiens | |

FOREIGN PATENT DOCUMENTS

| | | | |
|---|---|---|---|
| JP | 50033073 | U1 | 4/1975 |
| JP | 51038459 | U1 | 3/1976 |
| JP | 56019772 | U1 | 2/1981 |
| JP | 56124880 | U1 | 9/1981 |
| JP | 61057883 | U1 | 4/1986 |
| JP | 11258361 | A | 9/1999 |
| JP | 2010185683 | A | 8/2010 |

OTHER PUBLICATIONS

Japanese Office Action dated Sep. 19, 2017 issued in counterpart Japanese Application No. 2016-037131.

Japanese Office Action (and English language translation thereof) dated Dec. 4, 2018 issued in counterpart Japanese Application No. 2016-037131.

Chinese Office Action (and English language translation thereof) dated Dec. 5, 2018 issued in counterpart Chinese Application No. 201710027436.3.

* cited by examiner

DIAL AND TIMEPIECE

BACKGROUND OF THE INVENTION

1. Field of the Invention

The present invention relates to a dial and a timepiece.

2. Description of Related Art

There have been conventionally adopted dials for timepieces and such like, the dials including plate-like members for performing various types of function display in addition to dial main bodies forming main display parts.

For example, Japanese Patent Application Laid Open Publication No. H11-258361 describes a configuration of a clock in which plate members (plate-like rotating bodies) are provided so as to be rotatable in addition to a dial main body, the plate members including an hour circular plate with printed hour numbers, a minute plate with printed arrows or the like indicating minutes and a second plate with printed arrows or the like indicating seconds.

In a case of including a plurality of plate members in a display part as described above, it is possible to achieve a dial and a timepiece which are three-dimensional and excellent in design.

However, it is difficult to form a rotating body in an exact circle. Thus, when the rotating body is rotated, the rotating body is rotated eccentrically to some degree, generating waviness and distortion.

As the rotating body has a larger diameter, the rotation of the rotating body is more eccentric for the increase amount of the diameter, and the waviness and distortion of the rotating body during rotation becomes noticeable.

Such waviness and the like due to the eccentricity are especially noticeable for a peripheral portion of the rotating body.

Further, as for a timepiece including a rotating body in addition to a dial main body in the display part, in a case where the rotating body is merely supported by a rotation shaft, the rotating body may be detached, and may be damaged or broken due to, for example, the contact with other members such as a hand made of metal when an impact is applied to the rotating body from outside due to the fall or the like.

SUMMARY OF THE INVENTION

An object of the present invention is to provide a dial and a timepiece which, when including a rotating body, make waviness or the like of the rotating body be less noticeable and which are excellent in impact resistance, the waviness or the like being caused by eccentricity when the rotating body is rotated.

In order to solve the above object, according to one aspect of the present invention, there is provided a dial including: a rotating body which is provided to be rotatable; and a dial main body which includes a covering section that covers a peripheral portion of the rotating body.

BRIEF DESCRIPTION OF THE DRAWINGS

The above and other objects, advantages and features of the present invention will become more fully understood from the detailed description given hereinafter and the appended drawings which are given byway of illustration only, and thus are not intended as a definition of the limits of the present invention, and wherein.

DETAILED DESCRIPTION OF THE PREFERRED EMBODIMENT

Figure 1:
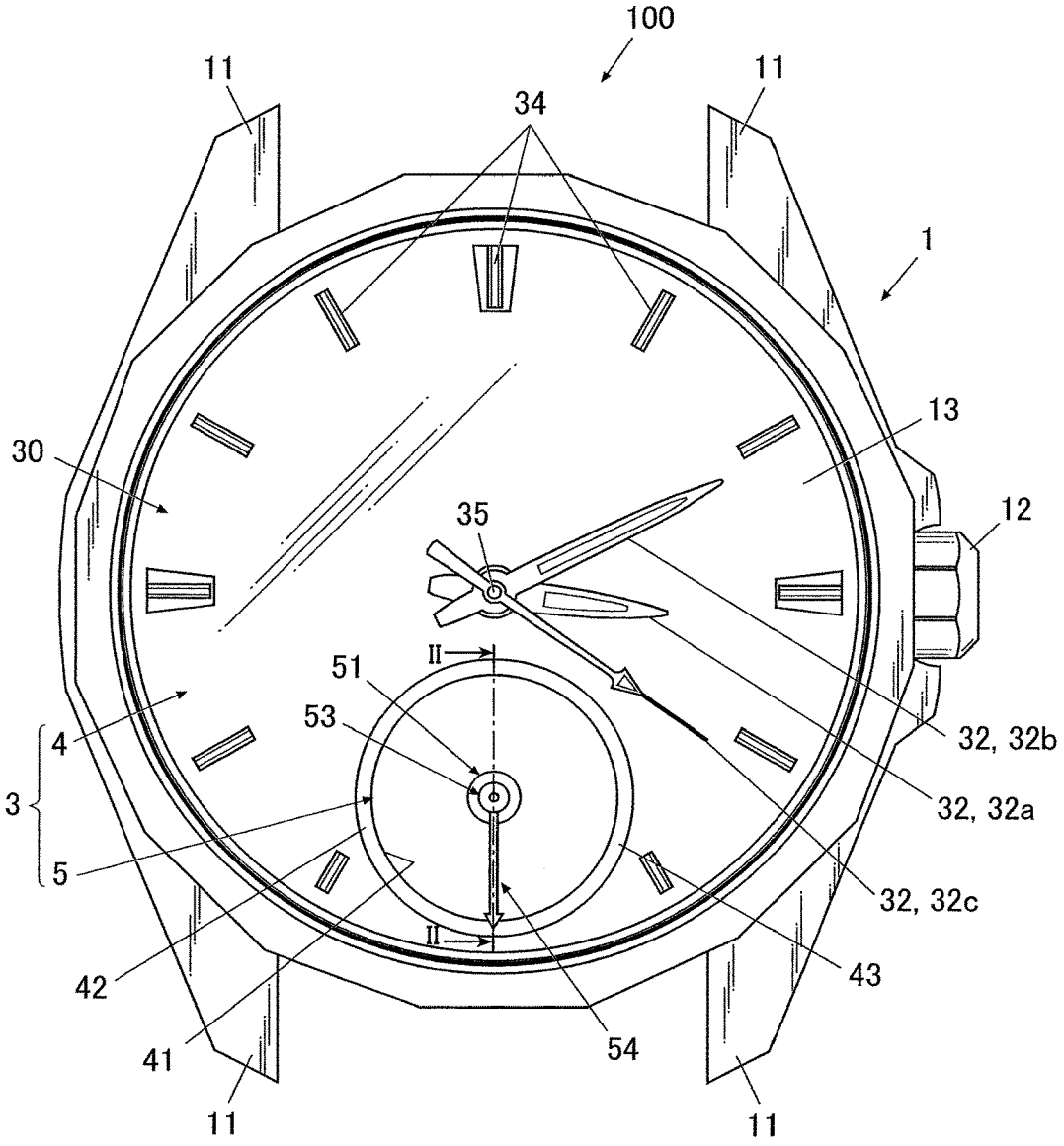
FIG. 1 is a front view of a timepiece including a dial in an embodiment.
Figure 2:
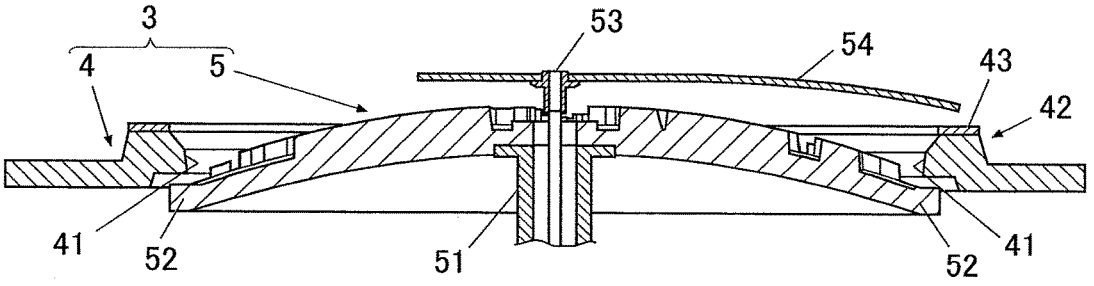
FIG. 2 is a main part sectional view along the line II-II in FIG. 1.

With reference to FIGS. 1 and 2, an embodiment of a dial and a timepiece using the dial according to the present invention will be specifically described.

The embodiments described below include various limitations which are technically preferred for implementing the present invention. However, the scope of the present invention is not limited to the following embodiments and illustrated examples.

FIG. 1 is a front view showing a timepiece including a dial in an embodiment.

A watch 100 includes a case (hereinafter, referred to as a "watch case 1") which is formed to be a hollow short column and open on a front and back side in the thickness direction of the watch.

Band attachments 11 for attaching a watch band (not shown in the drawings) are provided to the upper and lower ends of the watch case 1 in FIG. 1, that is, the ends on the 12 o'clock side and the 6 o'clock side of the watch.

The watch 100 includes an operation button 12 on a lateral side or the like of the watch case 1.

The inserted end of the operation button 12 is connected to a watch module (not shown in the drawings) which is contained inside the watch case 1, and various operations can be performed by pushing or rotating the operation button 12.

The visible-side (front side) opening of the watch case 1 is covered by a windshield member 13 formed of transparent glass or the like.

The opening on the opposite side (back side) to the visible side of the watch case 1 is covered by a back cover member which is not shown in the drawings.

A display section 30 is disposed below the windshield member 13 inside the watch case 1.

As shown in FIG. 1, the display section 30 in the embodiment is an analog type display section which includes a dial 3, and an hour hand 32*a*, a minute hand 32*b*, a second hand 32*c* and such like that are hands 32 disposed above the dial 3.

The display section 30 provided in the watch 100 is not limited to the analog type. For example, the display section 30 may be a digital type display section which is formed of a liquid crystal panel, or the display section 30 may be a display section including both of the analog type and digital type.

A clock module (not shown in the drawings) is disposed below (that is, on the back side of the watch 100) the display section 30 inside the watch case 1.

The clock module includes a gear train mechanism and a hand movement mechanism including a motor or the like (none of them shown in the drawings) in the housing formed of a resin, for example. The clock module incorporates therein a circuit board on which various electronic components are mounted, a battery for supplying electric power to each functional section, and such like.

The clock module is provided with a hand shaft 35 protruding towards the front side (visible side) of watch 100. The base end of hand shaft 35 is connected to the hand movement mechanism, and the free end (protruding end) penetrates the dial 3 (dial main body 4 in the embodiment)

and is exposed to visible side. The hands 32 (hour hand 32*a*, minute hand 32*b* and second hand 32*c*) are attached to the free end of hand shaft 35.

The clock module moves the hour hand 32*a*, minute hand 32*b* and second hand 32*c* attached to the hand shaft 35 above the dial 3 by rotating the hand shaft 35.

As shown in FIG. 1, the dial 3 in the embodiment includes a dial main body 4 and a rotating body 5.

The dial main body 4 is a flat plate member. On the peripheral portion of the front side of the dial main body 4, there are disposed time indicating members 34 which are a reference of time indicated by the hour hand 32*a*, minute hand 32*b* and second hand 32*c*.

As shown in FIG. 1, an opening 41 for exposing the rotating body 5 is formed nearly at the 6 o'clock position of the dial main body 4.

FIG. 2 is a sectional view along the line II-II in FIG. 1.

As shown in FIGS. 1 and 2, the rotating body 5 is disposed at the position corresponding to the opening 41 on the back side of the dial main body 4.

The rotating body 5 in the embodiment is formed by molding a resin with a mold, a die or the like, for example. The material and method for forming the rotating body 5 are not especially limited. The rotating body 5 is not limited to a body formed by resin molding, and may be formed of a material such as metal which is not the resin.

The rotating body 5 is provided with a supporting shaft 51 nearly at the center. The rotating body 5 is a plate-like member which is formed to be rotatable around the supporting shaft 51.

That is, the base end of the supporting shaft 51 (the lower end in FIG. 2) is connected to the clock module, and the clock module rotates the rotating body 5 by rotating the supporting shaft 51.

The rotating body 5 is formed in a nearly dome shape which slopes so as to be highest at the central portion (that is, the portion where the supporting shaft 51 is provided) as the center of rotation and be lowered toward the peripheral portion. The outermost peripheral portion of the rotating body 5 is a flat plate 52 which is formed to be flat.

The rotating body 5 has the diameter larger than the diameter of the opening 41 of the dial main body 4 at least for the amount of the flat plate 52. Thus, the flat plate 52 is covered with a peripheral portion peripheral to the opening 41.

In such way, in the embodiment, the peripheral portion peripheral to the opening 41 in the dial main body 4 functions as a covering section 42 which covers at least the peripheral portion of the rotating body 5.

The covering section 42 is formed at a raised position with respect to the other portion of dial main body 4 so as to have a gap with the upper surface of flat plate 52 of the rotating body 5 so that the lower surface (lower surface in FIG. 2) of covering section 42 does not contact the upper surface (upper surface in FIG. 2) of flat plate 52 of the rotating body 5.

On a visible-side surface (upper surface in FIG. 2) in the covering section 42, a protecting section 43 for protecting the surface from damage is formed.

The protecting section 43 is formed by attaching, to the upper surface (upper surface in FIG. 2) of the covering section 42, an adhesive seal such as a metal letter obtained by processing a metal material into a sheet, for example.

The method for forming the protecting section 43 is not limited to the example illustrated here. The protecting section 43 may be anything as long as it is possible to prevent the upper surface of covering section 42 from being damaged or abraded by the hands 32 and a hand 54 (to be described later) moving above the dial 3. For example, the protecting section 43 may be formed by coating of ceramics and hard glass.

In the embodiment, the supporting shaft 51 is formed in a hollow tube shape, and a hand shaft 53 for supporting a hand is inserted into the tubular supporting shaft 51.

The hand shaft 53 has the base end connected to the clock module and the free end protruding toward the front side of the rotating body 5. The hand 54 is attached to the protruding end of the hand shaft 53.

The embodiment is described by taking, as an example, a case where the hand 54 is a small hand (function hand) supported by the hand shaft 53 and rotating above the rotating body 5.

As shown in FIG. 2, the tip of the hand 54 is lowered towered the dial 3 along the surface shape of rotating body 5. The shape of the hand 54 and such like are not limited to the illustrated example.

Next, the function of a dial and a timepiece using the dial in the embodiment will be described.

In the embodiment, the hand shaft 35 is first set to the nearly central portion in the plane direction of the clock module, and the supporting shaft 51 having the hand shaft 53 inserted therein is set to the 6 o'clock side in the clock module. Then, the rotating body 5 formed by resin molding or the like is attached to the free end of the supporting shaft 51.

The dial main body 4 is placed on the clock module by performing positioning so that the opening 41 is located above the rotating body 5. Thereby, the rotating body 5 is exposed from the opening 41 to the visible side of the watch 100, and the flat plate 52 which is the peripheral portion of the rotating body 5 is covered with the covering section 42 which is the peripheral portion peripheral to the opening 41. Further, the protecting section 43 is formed by bonding a metallic seal to the surface of the covering section 42, for example. Then, the dial 3 is completed.

The hands 32 are attached to the free end of the hand shaft 35, the hand 54 is attached to the free end of the hand shaft 53, and then the display section 30 in the embodiment is completed.

The display section 30 including the clock module and the dial 3 is contained in the watch case 1, the windshield member 13, the back cover member and such like are attached, and the watch 100 is completed.

In the embodiment, the rotating body 5 and the hand 54 are rotated independently or in conjunction with each other, and perform various function display or such like.

At this time, as the rotating body 5 has a larger diameter, more waviness and distortion are generated due to the eccentricity when the rotating body 5 is rotating. Such waviness and such like are especially noticeable for the peripheral portion of the rotating body 5. However, in the embodiment, since the flat plate 52 which is the peripheral portion of the rotating body 5 is covered with the covering section 42 of the dial main body 4, the waviness and such like of the rotating body 5 are less noticeable.

Since a part of the rotating body 5 is covered with the dial main body 4 in such way, when the watch 100 falls, for example, the rotating body 5 is less likely to be detached from the clock module or detached from the supporting shaft 51 to deviate from its position even if an impact is applied from outside.

Since it is possible to avoid positional deviation and jumping due to impact in such way, it is also possible to prevent the surface of rotating body 5 from being damaged due to contact with other components such as the hands 32 and hand 54.

Further, since the protecting section 43 is formed on the surface of covering section 42, it is also possible to prevent the surface of covering section 42 covering the peripheral portion of the rotating body 5 from being damaged due to contact with other components such as the hands 32 and the hand 54.

As described above, according to the embodiment, a dial 3 includes a plate-like rotating body 5 which is provided to be rotatable and a dial main body 4 which includes a covering section 42 covering at least a flat plate 52 that is a peripheral portion of the rotating body 5. Thus, the dial 3 can have a configuration which is three-dimensional and excellent in design, and further it is possible to prevent the rotating body 5 from being detached from the supporting shaft 51 and damaged or abraded due to the contact with other members even when the watch 100 receives an impact.

Since the rotating body 5 is not formed in an exact circle, as the rotating body 5 has a larger diameter, the waviness and distortion due to the eccentricity are generated more when the rotating body 5 is rotated. Such waviness and such like are especially noticeable for the peripheral portion of the rotating body 5. However, since the flat plate 52 which is the peripheral portion of the rotating body 5 is covered with the covering section 42 of the dial main body 4 in the embodiment, the waviness and such like to some degree of the rotating body 5 are not noticeable.

Since the peripheral portion of the rotating body 5 can be covered with the covering section 42, when the rotating body 5 is manufactured, for example, there is no influence on the appearance of the dial 3 and the watch 100 even when the peripheral portion is not strictly processed. Thus, it is possible to improve the productivity of the rotating body 5.

For example, when the rotating body 5 is formed by resin molding using a mold, a gate for pouring a resin into the mold is necessary. When the gate part is exposed to the visible side, the appearance is wrong. However, since the peripheral portion of the rotating body 5 is covered with the covering section 42 in the embodiment, the gate part provided at the peripheral portion of the rotating body 5 is covered to be hidden by the covering section 42 after the setting. Thus, the gate part is not exposed to the visible side and the appearance is not influenced. Thus, it is possible to easily design a mold and mold a resin, and improve the productivity of the rotating body 5.

Also, in a case of performing surface treatment to the rotating body 5, the appearance when the watch is completed is not influenced even if the peripheral portion of rotating body 5 was fixed to a jig or touched by a hand since the peripheral portion is covered with the covering section 42. Thus, the treatment can be performed easily and the workability is improved.

Since a part of the rotating body 5 is covered with the dial main body 4 in such way, it is possible to prevent the rotating body 5 from being detached from the clock module and detached from the supporting shaft 51 to deviate from its position even when an impact is applied from outside, for example, when the watch 100 falls.

Since the positional deviation and jumping are not generated by the impact and such like, it is also possible to prevent the surface of rotating body 5 from being damaged due to the contact with other components such as the hands 32 and the hand 54.

Further, since the protecting section 43 is formed on the surface of covering section 42 of the dial main body 4, it is possible to prevent the surface of covering section 42 which covers the peripheral portion of the rotating body 5 from being damaged due to the contact with other components such as the hands 32 and the hand 54.

In the embodiment, the rotating body 5 has a shape sloping so as to be highest at the central portion which is the center of rotation and be lowered toward the peripheral portion. Thus, the dial 3 can be more three-dimensional and excellent in design.

Further, since the outermost peripheral portion of the rotating body 5 is a flat plate 52 formed to be flat and the flat plate 52 is covered with the covering section 42, compared to a case of covering a sloping surface, the entire rotating body 5 is uniformly covered without inclination and thus can be appropriately protected from jumping and such like.

The rotating body 5 in the embodiment is formed by molding a resin. Thus, even various complicated shapes can be easily processed or molded, and it is possible to form a dial 3 including a rotating body 5 which has variations of designs and is excellent in design. Further, when forming the rotating body 5 by resin molding using a mold, for example, the gate part can be located easily and productivity can be improved as described above.

Though the embodiment of the present invention has been described above, the present invention is not limited to the embodiment, and various modifications can be made within the scope of the present invention.

For example, the embodiment has been described by taking, as an example, a case where the entire appearance of the rotating body 5 is nearly in a hemisphere shape with the cross-sectional shape gradually curved so as to be highest at the central portion which is the base end and be lowered toward the peripheral portion which is the free end. However, the shape of the rotating body 5 is not limited to this.

For example, the rotating body 5 may be in a conical shape with a cross-sectional shape being linearly inclined so as to be highest at the central portion which is the base end and be lowered toward the peripheral portion which is the free end.

The entire rotating body 5 may be a flat disc. The rotating body 5 is not limited to a disc and may be a polygonal plate-like member.

The dial 3 maybe anything as long as it includes a rotating body 5 and another member which has a covering section covering at least the peripheral portion of the rotating body 5. The member having the covering section is not limited to a member (dial main body 4 in the embodiment) having time indicating members 34 and such like. For example, in a case where the dial 3 is formed of three plate-like members or more including the rotating body 5, the members may be anything as long as the covering section covering the peripheral portion of the rotating body 5 is provided to any one of the members.

The embodiment has been described by taking, as an example, a case where the hand shaft 53 is provided inside the supporting shaft 51 supporting the rotating body 5 and the hand 54 which is the function hand is supported by the hand shaft 53. However, the hand shaft 53 and the hand 54 which is a function hand are not essential elements of the present invention, and the present invention may be a configuration not including the hand shaft 53 and the hand 54.

The embodiment has been described by taking, as an example, a case where a protecting section 43 is formed on the surface of the covering section 42. However, it is not essential to provide the protecting section 43 on the surface of the covering section 42, and the present invention may be a configuration not providing the protecting section.

The embodiment has been described by taking, as an example, a case where the dial 3 is provided in the watch 100. However, the equipment to apply the dial of the present invention is not limited to a timepiece, and the present invention can be widely applied as long as the dial including the rotating body can be disposed in the equipment.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2016-037131 filed on Feb. 29, 2016 including description, claims, drawings, and abstract are incorporated herein by reference in its entirety.

What is claimed is:

1. A dial comprising:

a rotating body which is provided to be rotatable; and a dial main body which includes a covering section that covers a peripheral portion of the rotating body, wherein:

a ring-shaped protecting section which protects a visible-side surface of the covering section from damage is provided on the visible-side surface, the rotating body slopes so as to be highest at a central portion which is a center of rotation and so as to lower toward the peripheral portion, and an outermost peripheral portion of the rotating body is a flat plate, the covering section covers the flat plate, and an opening is provided in the dial main body, and the central portion of the rotating body is exposed from the opening to a visible side of the dial main body.

2. The dial according to claim 1, wherein the rotating body is formed by molding a resin.

3. The dial according to claim 2, further comprising a hand which is rotatable above the rotating body, wherein the hand is disposed on the visible side with respect to the dial main body.

4. The dial according to claim 1, further comprising a hand which is rotatable above the rotating body, wherein the hand is disposed on the visible side with respect to the dial main body.

5. The dial according to claim 4, wherein the ring-shaped protecting section is provided only at a position corresponding to an end of the hand.

6. A timepiece comprising:

a dial including:

a rotating body which is provided to be rotatable; and a dial main body which includes a covering section that covers a peripheral portion of the rotating body, wherein a ring-shaped protecting section which protects a visible-side surface of the covering section from damage is provided on the visible-side surface; and a case which contains the dial, wherein:

the rotating body slopes so as to be highest at a central portion which is a center of rotation and so as to lower toward the peripheral portion, and an outermost peripheral portion of the rotating body is a flat plate, the covering section covers the flat plate, and an opening is provided in the dial main body, and the central portion of the rotating body is exposed from the opening to a visible side of the dial main body.

7. The timepiece according to claim 6, wherein the rotating body is formed by molding a resin.

8. The timepiece according to claim 6, further comprising a hand which is rotatable above the rotating body, wherein the hand is disposed on the visible side with respect to the dial main body.

9. The timepiece according to claim 8, wherein the ring-shaped protecting section is provided only at a position corresponding to an end of the hand.

* * * * *